US005967866A

United States Patent [19]

Willows et al.

[11] Patent Number: 5,967,866

[45] Date of Patent: Oct. 19, 1999

[54] TEXTURE GEARCASE FOR A MARINE PROPULSION SYSTEM

[75] Inventors: Kurt D. Willows, West Bend; Timothy M. Fuhrmann, Fond du Lac, both of Wis.

[73] Assignee: Brunswick Corporation, Lake Forest, Ill.

[21] Appl. No.: 08/982,547

[22] Filed: Dec. 2, 1997

[51] Int. Cl.[6] ..... B63H 20/32; B63H 21/32

[52] U.S. Cl. ..... 440/76; 440/89

[58] Field of Search ..... 440/53, 66, 89, 440/76, 78; 114/285

[56] References Cited

U.S. PATENT DOCUMENTS

| | | | |
|---|---|---|---|
| 3,745,964 | 7/1973 | Henrich | 440/89 |
| 3,788,267 | 1/1974 | Strong . | |
| 4,636,175 | 1/1987 | Frazzell et al. . | |
| 4,767,366 | 8/1988 | Lang . | |
| 4,871,334 | 10/1989 | McCormick . | |
| 4,897,061 | 1/1990 | Koepsel et al. . | |
| 4,911,665 | 3/1990 | Hetzel . | |
| 5,085,603 | 2/1992 | Haluzak . | |
| 5,219,272 | 6/1993 | Steiner et al. . | |
| 5,277,634 | 1/1994 | Calamia et al. . | |
| 5,344,349 | 9/1994 | Meisenburg et al. | 440/66 |

*Primary Examiner*—Sherman Basinger
*Assistant Examiner*—Patrick Muldoon
*Attorney, Agent, or Firm*—Andrus, Sceales, Starke & Sawall

[57] ABSTRACT

A lower unit for a marine propulsion system has a flow disrupter positioned along the side wall of the vertical strut above the torpedo gearcase. The strut has a high pressure side and low pressure side which results from the strut being positioned at an angle with respect to the direction of boat travel in order to compensate for steering torque. The flow disrupter is positioned on the low pressure side of the strut, and promotes the separation of water passing over the vertical strut in a controlled manner, thereby reducing steering jerks during acceleration due to dramatic hydrodynamic flow changes. The flow disrupter consists of a series of steps or textured areas positioned along the aft section of the vertical strut. In a preferred embodiment, each of the steps contains a vent passage permitting exhaust to exit the strut through the steps to further promote controlled separation of water passing over the strut.

16 Claims, 3 Drawing Sheets

FIG. 4
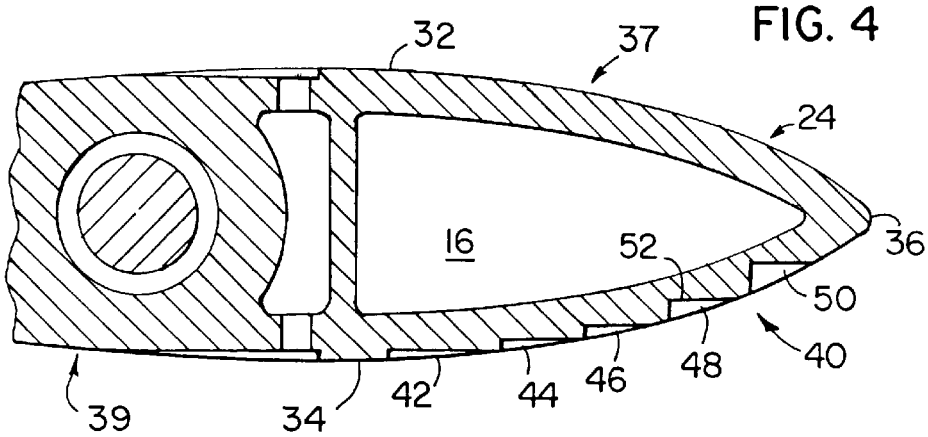
FIG. 5
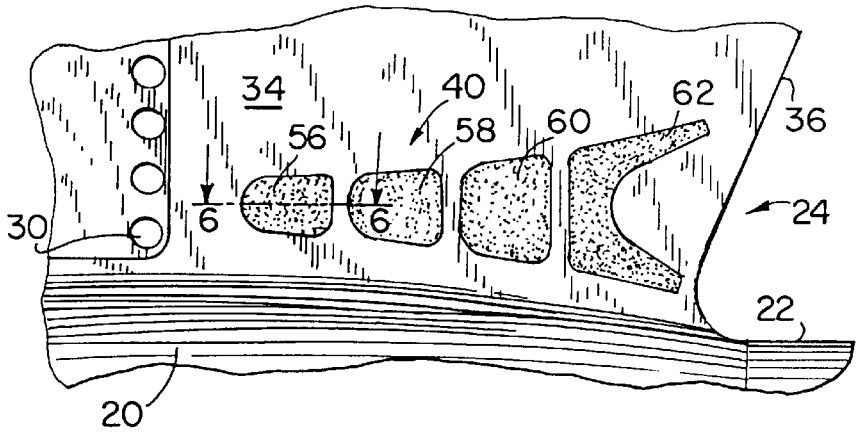
FIG. 6
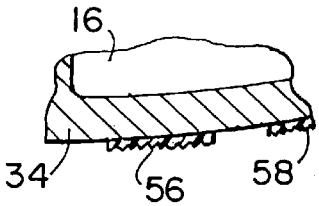
FIG. 8
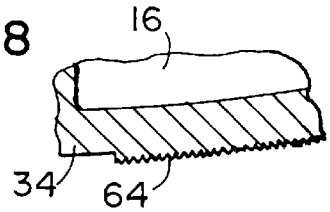
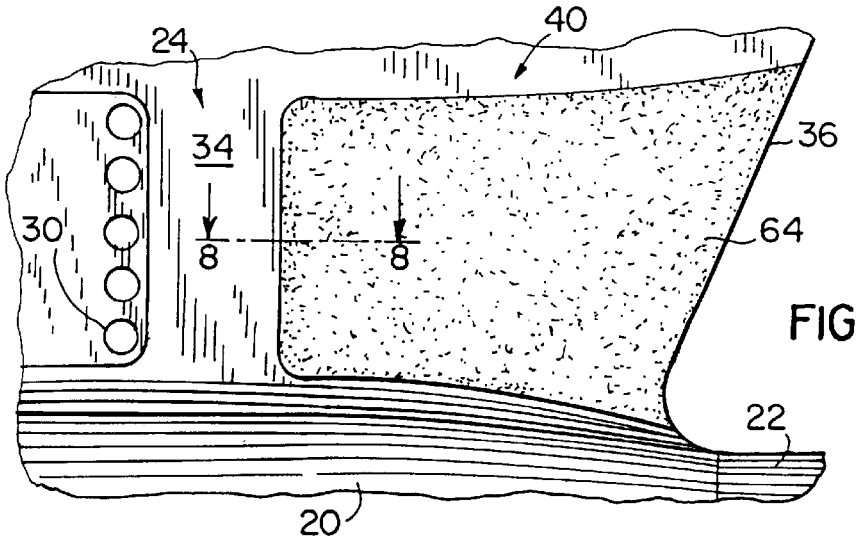
FIG. 7

TEXTURE GEARCASE FOR A MARINE PROPULSION SYSTEM

FIELD OF THE INVENTION

The invention relates to the configuration of the lower unit of a marine propulsion system. More specifically, the invention relates to a configuration having a stepped or textured area that is particularly useful in controlling the flow of water passing over a vertical strut portion of the lower unit.

BACKGROUND OF THE INVENTION

Marine propulsion systems, particularly those having a lower gearcase and a submerged propeller, are subject to steering torque. Steering torque results from the rotating propeller creating a torque that tends to force the boat into a turn when the strut is aligned parallel to the desired direction of boat travel. For example, with a right hand rotating propeller, the steering torque tends to direct the boat into a turn toward port. To counteract steering torque, the strut must be directed toward port to create a slight starboard turn which compensates for the steering torque and keeps the boat traveling along the desired path. Therefore, when the boat is traveling along a straight path, the submerged strut is positioned at a slight angle, called the "crab angle", with respect to the boat direction.

When the strut is no longer positioned parallel to the direction of the boat, a pressure differential develops between one side of the strut and the other side of the strut. On the low pressure side of the strut, which is the side turned to face downstream, the flow of the water over the relatively smooth side surface is generally laminar at low speeds. As the speed of the boat increases, the flow of the water over the low pressure side surface of the strut makes a dramatic and essentially instantaneous change from a laminar flow to a turbulent flow. The instantaneous change from laminar to turbulent flow further reduces the pressure on the low pressure side of the strut, which results in the driver of the boat feeling a sudden jerk or shock. The physical location on the strut at which the water separates from laminar flow to turbulent flow is located slightly above the torpedo gearcase on the aft end of the strut.

Therefore, it can be appreciated that a strut in a marine propulsion system having a device to control the separation of water from laminar flow to turbulent flow along the strut would be desirable. Specifically, a device which enables a gradual shift from laminar flow to turbulent flow would be particularly desirable.

SUMMARY OF THE INVENTION

The invention is a lower unit for a marine propulsion system that can be used to promote the controlled separation of water passing over the low pressure side surface of the strut. The invention therefore promotes a gradual shift from laminar flow to turbulent flow as boat speed increases, thereby reducing hydrodynamic steering jerks that can occur due to dramatic shifts from laminar to turbulent flow.

The lower unit of a marine propulsion system in accordance with the invention includes a torpedo gearcase and a submerged propeller positioned slightly aft from the torpedo gearcase. The submerged propeller is driven in a particular direction which produces steering torque accordingly in a given direction. The lower unit also includes a vertical strut integral with and positioned above the torpedo gearcase. The vertical strut extends between a cavitation plate and the torpedo gearcase. The vertical strut has a fore section and aft section and has a pair of streamline side surfaces which converge at both the aft end and fore end of the strut.

In accordance with the invention, a flow disrupter is positioned on one or both of the side surfaces of the vertical strut. The flow disrupter promotes the separation, from laminar flow to turbulent flow, of water passing over the side surfaces.

In a first embodiment of the invention, the flow disrupter consists of a series of steps contained in the side surface of the strut. The series of steps are positioned slightly above the torpedo gearcase. Each of the steps includes a depressed face surface that is located slightly inward from the side surface of the vertical strut. As water passes over the series of steps, the physical characteristics of the steps cause the water to separate at the most aft step first. As the speed of the boat increases, the water begins to separate at the steps located progressively forward of the aft end of the strut. In this manner, the water separates gradually, rather than in a single sudden occurrence.

In a second embodiment of the invention, the flow disrupter consists of a series of textured areas positioned slightly above the torpedo gearcase. The textured areas protrude slightly from the otherwise smooth side surface of the vertical strut. The width of the textured areas decreases from the most aft textured area to the most fore textured area, such that water passing over the textured areas will separate at the most aft textured area first.

In a third embodiment of the invention, the flow disrupter is a single textured area positioned slightly above the torpedo gearcase on the side surface of the strut. It is preferred that the textured area becomes progressively wider as the area proceeds rearward. The textured area protrudes slightly from the smooth side surface of the strut.

In a preferred embodiment of the invention, a series of vent passages are also included in the side surface. The vent passages provide communication between the internal exhaust passage contained in the vertical strut and the exterior of the strut. In this way, exhaust passing through the strut can exit the strut through each of the vent passages in the side surface. The exhaust exiting through the vent passages in the side surface further helps to promote the separation from laminar flow to turbulent flow of water passing over the side surface.

Other objects and advantages of the invention may appear in the course of the following description.

BRIEF DESCRIPTION OF THE DRAWINGS

The drawings illustrate the best mode presently contemplated of carrying out the invention.

In the drawings:

FIG. 4 is a partial sectional view taken generally along line A—A of FIG. 1 showing an alternate embodiment of the textured gearcase of FIG. 3 without the vent passages;

FIG. 5 is a detailed side view of a second embodiment of the textured gearcase showing a series of textured areas;

FIG. 6 is a partial sectional view taken along line 6—6 of FIG. 5 showing the protrusion of the textured areas of FIG. 5;

FIG. 7 is a detailed side view of a third embodiment of the textured gearcase showing a single textured area;

FIG. 8 is a partial sectional view taken along line 8—8 of FIG. 7 showing the protrusion of the single textured area;

DETAILED DESCRIPTION OF THE INVENTION

Figure 1:
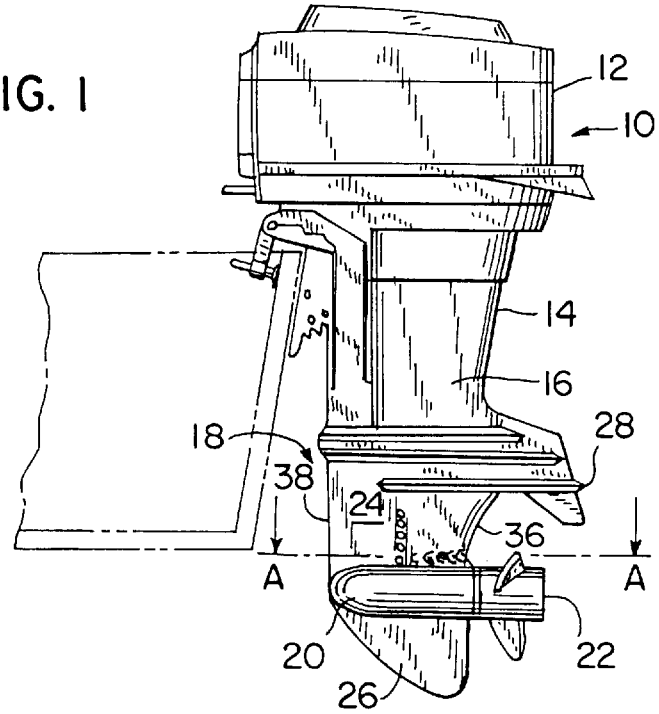
FIG. 1 is a side elevation view of an outboard marine motor and depending gearcase incorporating the textured gearcase according to the invention.

With reference to FIG. 1, an outboard motor 10 includes a power head 12 and a depending gearcase 14. Power head 12 typically includes an internal combustion engine (not shown) from which exhaust is routed through an internal exhaust passage 16 formed in gearcase 14. Exhaust passage 16 generally extends from the upper end of the gearcase 14 to the lower end 18 of the gearcase 14, hereinafter referred to as the lower unit 18.

A torpedo gearcase 20 is formed in the lower unit 18 of gearcase 14. The torpedo gearcase 20 houses a propeller shaft to which a propeller 22 is mounted. The torpedo gearcase 20 is generally connected to a vertical strut 24 at the upper end of the torpedo gearcase 20. A lower skeg 26 is connected to the lower end of the torpedo gearcase 20. The lower end of exhaust passage 16 communicates with an internal passage formed in the torpedo gearcase 20 which routes the exhaust gas therethrough and discharges exhaust underwater through or around the hub of the propeller 22.

The vertical strut 24 extends between the torpedo gearcase 20 and a cavitation plate 28 which extends over the propeller 22. The vertical strut 24 includes a series of water inlets 30, FIG. 2, that allow cooling water to enter the marine propulsion system.

Figure 2:
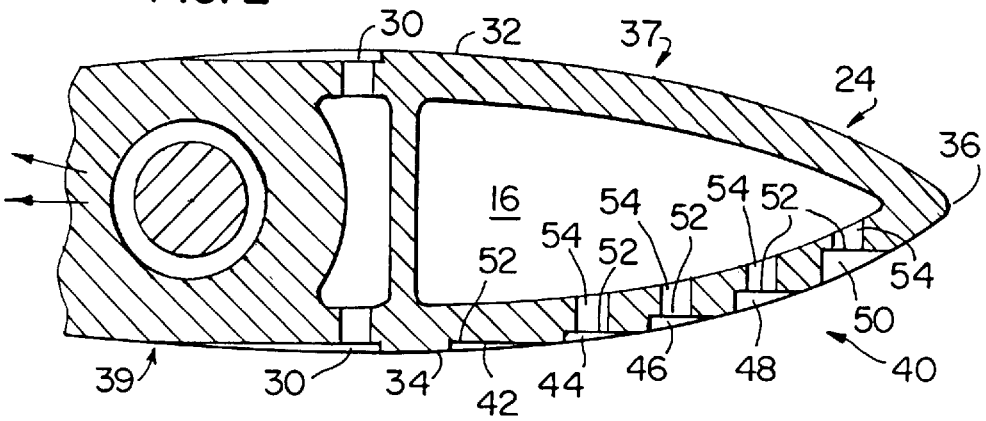
FIG. 2 is a partial sectional view taken generally along line A—A of FIG. 1 showing a first embodiment of the textured gearcase and the internal exhaust passageway.

Referring to FIG. 2, the vertical strut 24 has a pair of side walls 32 and 34. Each of the side walls 32 and 34 is arcuate in shape and converges at both the aft end 36 and the fore end 38 of the strut 24. The strut 24 is widest at a position near the water inlets 30, such that an aft section 37 tapers from the widest point of the strut 24 to the aft end 36 and a fore section 39 tapers from the widest point of the strut 24 to the fore end 38. The side walls 32 and 34 are shaped to create a streamlined outer surface which can efficiently pass through water with minimal drag.

Figure 3:
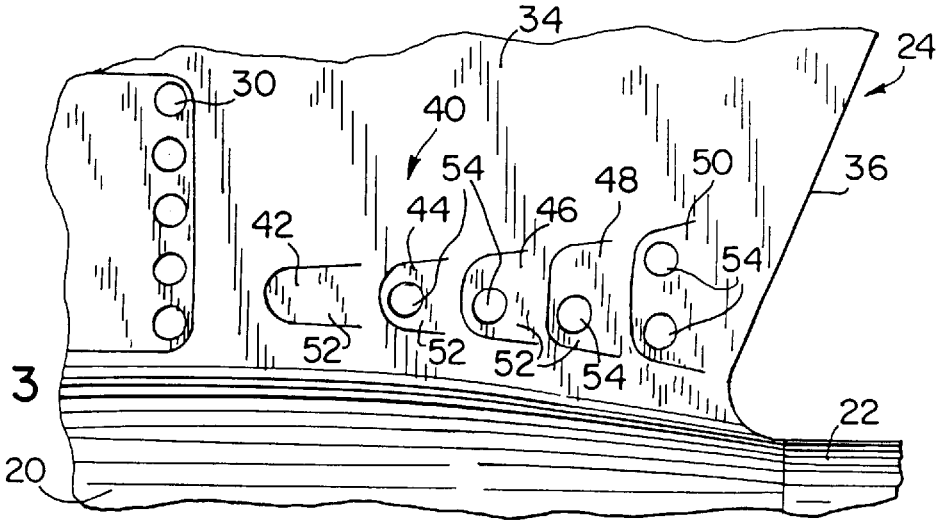
FIG. 3 is a detailed side view of the textured gearcase of FIG. 2 showing a series of steps and vent passages.

FIGS. 2 and 3 show the preferred embodiment of the invention. The particular embodiment shown in FIGS. 2 and 3 is particularly useful with a right hand rotating propeller. A right hand rotating propeller creates a steering torque that tends to force the boat into a turn toward the port side of the boat. To compensate for steering torque, the driver of the boat must turn the motor 10 in a direction to create a slight starboard turn to cancel out the steering torque toward port.

Because of the need to compensate for steering torque, the vertical strut 24 is not positioned parallel to the direction of travel of the boat. This, therefore, creates a high pressure side and a low pressure side of the vertical strut 24. In FIG. 2, side wall 32 represents the high pressure side, while side wall 34 represents the low pressure side. In the following discussion, it is understood that the high pressure side and the low pressure side would be reversed for a left hand rotating propeller.

FIGS. 2 and 3 show a flow disrupter 40 positioned along the side wall 34 of the vertical strut 24. The flow disrupter 40 in the first embodiment of the invention consists of a series of steps 42,44,46,48 and 50 positioned from near the midpoint of side wall 34 to near the aft end 36 of the vertical strut 24. The flow disrupter 40 is located at this location because water normally separates near this location on a vertical strut 24 not having a flow disrupter.

Each of the steps 42–50 includes a flat face surface 52 depressed inwardly from the exterior side wall 34. As the steps 42–50 are positioned closer to the aft end 36, the flat face surface 52 of each step is recessed a greater distance from the exterior side wall 34. Since step 50 is the deepest, it should create the greatest disturbance in water flowing over the side wall 34.

At relatively low speeds, water flows across the shallow first step 42 and will reattach to the strut 24 before reaching the second step 44. At low speeds, water continues to reattach to the strut 24 after each step and the flow of water will remain laminar.

As the boat speed increases, water begins to separate from laminar flow to turbulent flow at the furthest aft step 50. As the speed of the boat continues to increase, water will next separate at step 48. Water will continue to separate at the steps located progressively forward from the aft end 36 as the boat speed increases, until water eventually separates at step 42. The series of steps, therefore, causes the water to separate in a series of controlled events, unlike the prior art in which the water separated in a single, dramatic event.

As can be seen in FIG. 3, the width of the steps 42-50 increases as the steps are located closer to the aft end 36. The wider steps create a larger disturbance in the water flow. This ensures that water separates at the most aft step 50 first.

In a preferred configuration of the first embodiment, each of the steps 44–50 contains a vent passage 54 that communicates between the internal exhaust passageway 16 and the exterior of the vertical strut 24. The series of vent passages 54 creates a bypass for exhaust traveling through the internal exhaust passageway 16, thus allowing exhaust to exit the vertical strut 24 through each of the vent passages 54. In a preferred embodiment, each of the exhaust passages is a 3/16 inch diameter circular bore.

During normal operation of the marine propulsion system shown in the figures, the exhaust in the internal exhaust passageway 16 is at a given pressure, called the back pressure. The water flowing over the vertical strut 24 creates a pressure on the side surface 34 which is less than the back pressure within the internal exhaust passageway 16. Therefore, the pressure differential between the internal exhaust passageway 16 and the water flowing over the side wall 34 allows exhaust to exit through the vent passages 54. The flow of exhaust gas through the vent passages 54 acts to further promote the separation of water flowing over the side wall 34.

As can be seen in FIG. 3, the step 50 located closest to the aft end 36 contains a pair of vent passages 54. The pair of vent passages 54 in step 50 further helps to ensure that water passing over side wall 34 separates at step 50 before any other step. The exhaust that does not exit through the series vent passages 54 continues to travel through the internal exhaust passageway 16 and exits through the hub of the propeller 22.

FIG. 4 shows a second embodiment of a flow disrupter 40 on the side wall 34 of the vertical strut 24. Like the embodiment previously described in FIGS. 2 and 3, the flow disrupter 40, in FIG. 4, consists of a series of steps 42–50. Each of the steps contains a flat face surface 52 recessed inwardly from the exterior surface of the side wall 34. As in the first embodiment, the distance the flat face surface 52 is recessed from the side wall 34 increases as the steps move toward the aft end 36 of the vertical strut 24. Unlike the first embodiment shown in FIGS. 2 and 3, the second embodiment of the flow disrupter 40, shown in FIG. 4, does not include a series of vent passages between the steps and the internal gas passageway 16.

The width of each step 42–50 in the second embodiment of the flow disrupter 40 shown in FIG. 4 corresponds to the steps shown in FIG. 3. Therefore, step 50 is the widest and deepest of the series of steps. In operation, as water passes over the low pressure side wall 34, the water will first separate at the step 50 located nearest the aft end 36 of the vertical strut. As the speed of the boat increases, water next separates at step 48 which is located further forward from the aft end 36. Water continues to separate further forward from the aft end 36 of the vertical strut 24 as the speed of the boat increases. The series of steps allows the water to separate in a series of small occurrences and prevents the sudden separation from laminar flow to turbulent flow as in a vertical strut 24 devoid of a flow disrupter 40.

Referring now to FIGS. 5 and 6, a third embodiment of the flow disrupter 40 is shown. The third embodiment of the flow disrupter 40 consists of a series of textured areas 56,58,60 and 62. The series of textured areas 56-62 are positioned slightly above the torpedo gear case 20 on the aft section 37 of the vertical strut 24. The series of textured areas 56–62 can be created by a variety of methods, such as applying an adhesive-backed frictional material to the side wall 34 as shown in the figures. Additionally, the textured areas 56–62 could be integrally formed in the side wall 32 or 34.

As is shown in FIG. 5, the width of each textured area increases as the textured area is positioned further aft on the vertical strut 24. As in the first two embodiments, the widest textured area 62 tends to create the largest disturbance and therefore promotes flow separation near the aft end 36 first. As can be seen in FIG. 6, the textured area 56 protrudes slightly from the otherwise smooth side wall 34. The remaining members 58, 60 and 62 of the series of textured areas similarly protrude from the side wall 34.

During operation of the marine propulsion system, water flows over the low pressure side wall 34 in a laminar flow pattern at low speeds. As the speed of the boat increases, the protruding aftmost textured area 62 causes the water to separate into turbulent flow at this area. Water next separates at the textured area 60 and continues to separate further forward of the aft end 36 as the speed of the boat continues to increase. In this manner, water separates at the aftmost textured area 62 first, and begins to separate progressively forward of the aft end 36 as the speed increases. Therefore, the separation of the water occurs in a series of steps and in a controlled manner as in the first two embodiments previously described.

Referring now to FIGS. 7 and 8, a fourth embodiment of the flow disrupter 40 is shown. In this embodiment, a single textured area 64 is positioned slightly above the torpedo gearcase 20 of the aft section 37 of the vertical strut 24. As can be seen in FIG. 7, the textured area 64 is wider at its aftmost end and is tapered from its aft end to its fore end. As shown in the cross section of FIG. 8, the textured area 64 slightly protrudes from the otherwise smooth side wall 34. The textured area 64 is formed integrally with the side wall 34 and contains a rough outer surface. As water flows over the vertical strut 24, the wider aft end of the textured area 64 creates the greatest disturbance which causes the water to separate from laminar flow to turbulent flow near the aft end 36 first. As the speed of the boat increases, the water begins to separate at a location further away from the aft end 36 of the vertical strut 24. In this manner, the textured area 34 controls the separation of water such that water separates in a continuous manner from the aft end moving forward.

Figure 9:
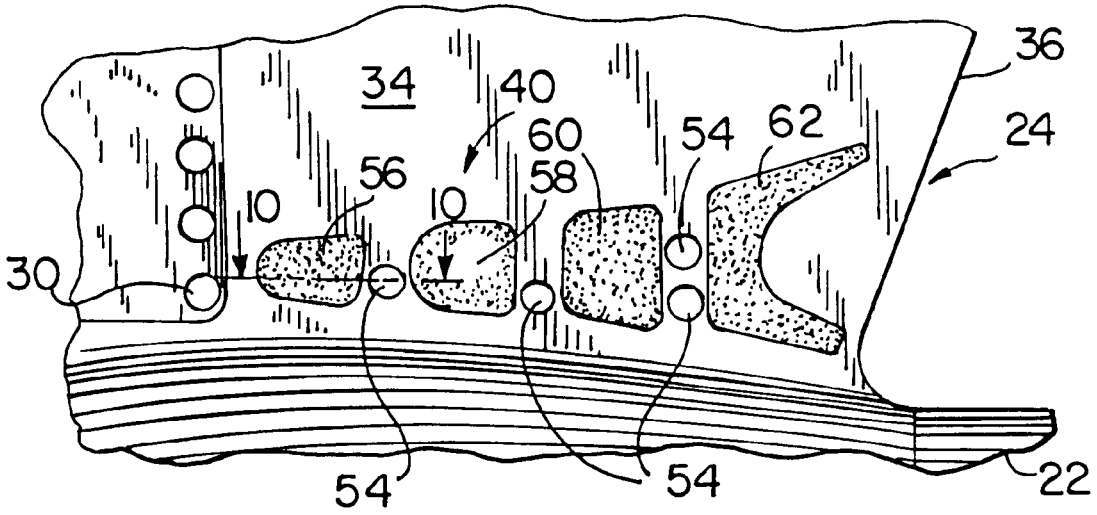
FIG. 9 is a detailed side view of an alternate embodiment of the textured gearcase shown in FIG. 5 having a series of textured areas and vent passages.
Figure 10:
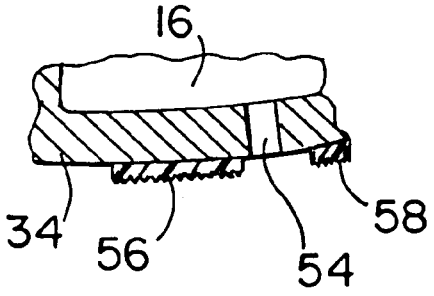
FIG. 10 is a partial sectional view taken along line 10—10 of FIG. 9 showing the protrusion of the textured areas and the vent passages of FIG. 9.

Referring now to FIGS. 9 and 10, a fifth embodiment of the flow disrupter 40 is shown. Like the third embodiment shown in FIGS. 5 and 6, the flow disrupter 40 consists of a series of textured areas 56,58,60 and 62. The series of textured areas 56–62 are positioned slightly above the torpedo gearcase 20 on the aft section 37 of the vertical strut 24. As in the first embodiment, the width of each textured area increases as the textured area positioned further aft on the vertical strut 24.

In addition to the textured areas 56, the embodiment shown in FIGS. 9 and 10 contains a series of vent passages 54. Each of the vent passages 54 is positioned between a pair of textured areas and communicates between the internal exhaust passageway 16 and the exterior of the vertical strut 24. As previously described, the series of vent passages 54 creates a bypass for exhaust traveling through the internal exhaust passageway 16. The exhaust exiting through the vent passages 54 acts to further promote the separation of water flowing over the side wall 34. A pair of vent passages 54 are located between the textured area 60 and the textured area 62. The pair of vent passages 54 helps to further ensure that water passing over the side wall 34 separates near the textured area 62 first.

Although each embodiment of the flow disrupter 40 has been described as being positioned along the side wall 34, it should be understood that the flow disrupter can be positioned on either side wall, or on both side walls, depending on the type of propeller being used. The flow disrupters 40 described above should operate in an identical manner to promote controlled separation of water regardless of which side of the strut the flow disrupters 40 are positioned as long as flow disrupters 40 are located on the low pressure side of the strut.

In addition to being used on an outboard motor 10, the invention as described can be applied to a stern drive having a lower unit submerged below the water surface. The flow disrupter 40 disclosed would be equally effective on a stern drive to control the separation of water from laminar to turbulent flow.

It is thought that the present invention and its advantages will be understood from the foregoing description. The form of the invention described above are merely preferred or exemplary embodiments of the invention. It may be apparent that various changes can be made without departing from the spirit and scope of the invention and sacrificing all of its material advantages.

We claim:

1. A lower unit for a marine propulsion system, comprising:

a submerged propeller driven in one direction, the rotation of said propeller producing steering torque in a given direction;

a torpedo gearcase for supporting said propeller at a position aft of said torpedo gearcase;

a vertical strut positioned above and formed integrally with said torpedo gearcase, said strut having a fore section and an aft section and a pair of streamlined side walls converging at an aft end of said strut; and a flow disrupter positioned on one of said pairs of side walls of said strut, such that the flow disrupter promotes separation of water passing over the side wall of the strut from laminar flow to turbulent flow, wherein said flow disrupter consists of a series of textured areas positioned on said converging strut side wall slightly above said torpedo gearcase and on the aft section of said strut.

2. The lower unit of claim 1, wherein said textured areas protrude slightly from said side wall of said strut to promote the separation of water passing over the side wall.

3. The lower unit of claim 2, wherein the width of the textured areas decreases from the most aft textured area to the most fore textured area.

4. The lower unit of claim 2, wherein said lower unit further comprises:

an internal exhaust passageway formed in said lower unit and passing through the aft section of said strut; and a series of vent passages providing communication between said side wall and said internal exhaust passageway to further promote the separation of water passing over the side wall of said strut.

5. A lower unit for a marine propulsion system, comprising:

a submerged propeller driven in one direction the rotation of said propeller producing steering torque in a given direction;

a torpedo gearcase for supporting said propeller at a position aft of said torpedo gearcase;

a vertical strut positioned above and formed integrally with said torpedo gearcase, said strut having a fore section and an aft section and a pair of streamlined side walls converging at an aft end of said strut; and a flow disrupter positioned on one of said pair of side walls of said strut such that the flow disrupter promotes separation of water passing over the side wall of the strut from laminar flow to turbulent flow, wherein the flow disrupter is a single textured area positioned on said converging strut side wall slightly above said torpedo gearcase and on the aft section of said strut, said textured area protruding from the side wall of said strut to promote the separation of water passing over the side wall.

6. A lower unit for a marine propulsion system, comprising:

a submerged propeller driven in one direction, the rotation of said propeller producing steering torque in a given direction;

a torpedo gearcase for supporting said propeller at a position aft of said torpedo gearcase;

a vertical strut positioned above and formed integrally with said torpedo gearcase, said strut having a fore section and an aft section and a pair of streamlined side walls converging at an aft end of said strut; and a flow disrupter positioned on one of said pair of side walls of said strut, such that the flow disrupter promotes separation of water passing over the side wall of the strut from laminar flow to turbulent flow, wherein said flow disrupter comprises:

a series of steps contained in said side wall on the aft section of said strut, each of said steps having a recessed face surface located inwardly from said side wall of said strut.

7. The lower unit of claim 6, wherein the width of said steps progressively decreases from the most aft step to the most fore step.

8. The lower unit of claim 6, wherein said lower unit further comprises:

an internal exhaust passageway formed within said lower unit and passing through the aft section of said strut; and a series of vent passages providing communication between the recessed face surface of said steps and said internal exhaust passageway to further promote the separation of water passing over the side wall of said strut.

9. The lower unit of claim 8, wherein the step located furthest aft contains a pair of vent passages providing communication between the recessed face surface and the internal exhaust passageway to promote the separation of water at the furthest aft step first.

10. A lower unit for a marine propulsion device, comprising:

a submerged propeller driven in one direction and producing steering torque in a given direction;

a torpedo gearcase for supporting the propeller at a position aft of said torpedo gearcase;

a vertical strut positioned above and formed integrally with the torpedo gearcase, the strut having a fore section and aft section and a pair of streamlined side walls converging at an aft end of said strut, said vertical strut having a high pressure side and a low pressure side;

an internal exhaust passageway formed within the lower unit and passing through the aft section of said strut; and a flow disrupter positioned on the low pressure side of said strut, such that the flow disrupter promotes separation of the water passing over the low pressure side of the strut from laminar flow to turbulent flow, wherein the flow disrupter is a series of textured areas protruding from one of said pair of side walls and positioned slightly above said torpedo gearcase on the aft section of said strut.

11. A lower unit for a marine propulsion device, comprising:

a submerged propeller driven in one direction and producing steering torque in a given direction;

a torpedo gearcase for supporting the propeller at a position aft of said torpedo gearcase;

a vertical strut positioned above and formed integrally with the torpedo gearcase, the strut having a fore section and aft section and a pair of streamlined side walls converging at an aft end of said strut, said vertical strut having a high pressure side and a low pressure side;

an internal exhaust passageway formed within the lower unit and passing through the aft section of said strut; and a flow disrupter positioned on the low pressure side of said strut, such that the flow disrupter promotes separation of the water passing over the low pressure side of the strut from laminar flow to turbulent flow, wherein the flow disrupter is a single textured area protruding from one of said pair of side walls and positioned slightly above said torpedo gearcase on the aft section of said strut.

12. The improvement of claim 11, further comprising a series of exhaust vent passages providing communication between said internal exhaust passageway and the recessed face surface of the steps to further promote the water separation.

13. A lower unit for a marine propulsion device, comprising:

a submerged propeller driven in one direction and producing steering torque in a given direction;

a torpedo gearcase for supporting the propeller at a position aft of said torpedo gearcase;

a vertical strut positioned above and formed integrally with the torpedo gearcase, the strut having a fore section and aft section and a pair of streamlined side walls converging at an aft end of said strut, said vertical strut having a high pressure side and a low pressure side;

an internal exhaust passageway formed within the lower unit and passing through the aft section of said strut; and a flow disrupter positioned on the low pressure side of said strut such that the flow disrupter promotes separation of the water passing over the low pressure side of the strut from laminar flow to turbulent flow, wherein said flow disrupter comprises:

a series of steps contained in one of said pair of side walls of the strut on the aft section, each step having a flat recessed face surface located inwardly from the side wall.

14. The lower unit of claim 13, further comprising a series of vent passages communicating between the internal exhaust passageway and the flat recessed face surface of the steps.

15. In a marine propulsion system having a lower portion including a generally vertical streamlined strut having a fore section and aft section and a pair of side walls converging at an aft end of the strut, a torpedo gearcase at the lower end of the strut for supporting a propeller aft of the gearcase, and an internal exhaust passageway passing through the aft section of the strut, the improvement comprising:

a series of recessed steps in one of said pair of side walls of the strut, the steps having a recessed face surface positioned inwardly from the side wall of the strut, the steps being positioned on the low pressure side of the strut such that during operation of the marine propulsion system, the steps promote the separation of water flowing over the side wall, the steps being located slightly above the torpedo gearcase on the aft section of the strut.

16. In a marine propulsion system a method of controlling water separation along a lower unit having a pair of side walls, comprising the steps of:

supporting a submerged propeller on a torpedo gearcase integrally formed with a vertical strut;

rotating said submerged propeller, said rotating propeller producing a steering torque in a given direction;

operating said vertical strut at an angle relative to the direction of travel to compensate for said steering torque, said angle creating a low pressure side and a high pressure side of said vertical strut; and disrupting the flow of water passing over at least a portion of the low pressure side of said vertical strut, said disruption causing the flow of water to change from laminar to turbulent, wherein the step of disrupting the flow of water consists of positioning a flow disrupter on the low pressure side of said vertical strut, and further comprising the step of separating the flow of water over the low pressure side from laminar flow to turbulent flow in a series of events as the speed of the water passing over said vertical strut increases.

* * * * *